US005552201A

United States Patent [19]

Burgess et al.

[11] Patent Number: 5,552,201

[45] Date of Patent: Sep. 3, 1996

[54] PROTECTIVE DEVICES

[75] Inventors: Donald M. Burgess; Nicholas P. R. Legh-Heppel, both of London, England

[73] Assignee: Universal Shield Ltd., Wiltshire, England

[21] Appl. No.: 243,557

[22] Filed: May 16, 1994

Related U.S. Application Data

[63] Continuation of Ser. No. 825,302, Jan. 24, 1992, abandoned, which is a continuation of Ser. No. 457,739, filed as PCT/GB88/00562, Jul. 13,1988 published as WO89/00385, Jan. 26, 1989, abandoned.

[30] Foreign Application Priority Data

| | | | |
|---|---|---|---|
| Jul. 14, 1987 | [GB] | United Kingdom | 8716568 |
| Sep. 30, 1987 | [GB] | United Kingdom | 8722963 |
| Apr. 14, 1988 | [GB] | United Kingdom | 8808861 |

[51] Int. Cl.[6] ..... C09J 7/02

[52] U.S. Cl. ..... 428/43; 428/343; 428/351

[58] Field of Search ..... 428/40, 42, 43, 428/79, 343, 351; 2/16, 21

[56] References Cited

U.S. PATENT DOCUMENTS

| | | | |
|---|---|---|---|
| 3,255,949 | 6/1966 | Bultery | 428/43 |
| 3,403,815 | 10/1968 | Robson | 221/34 |
| 3,925,958 | 12/1975 | Heisig | 156/226 |
| 4,034,853 | 7/1977 | Smith | 428/43 |
| 4,646,364 | 3/1987 | O'Larey | 428/43 |

FOREIGN PATENT DOCUMENTS

| | | |
|---|---|---|
| 1421450 | 11/1965 | France . |
| 2164540 | 3/1986 | United Kingdom . |

*Primary Examiner*—Jenna L. Davis
*Attorney, Agent, or Firm*—Ladas & Parry

[57] ABSTRACT

A protective device for the hand is provided which comprises a sheet conforming to the shape of at least part of the hand and having disposed over at least a portion thereof a heat or pressure-sensitive adhesive. The material can be microporous sheet. The devices can be formed on a release sheet preferably conforming in shape to the device. The release sheet can have a solid portion corresponding to the individual finger portions of the device. Conveniently, the devices are formed in a continuous sheet by rupturable lines and release sheets can cover the continuous sheet until ready for use. In a preferred form of the device corresponding portions of the opposed surface readily release from adhesive portions of an adjacent device. The opposed surface has enhanced release properties being treated with a release agent such as silicone. The adhesive bearing portions being adjacent to the release portions of the adjacent device.

8 Claims, 1 Drawing Sheet

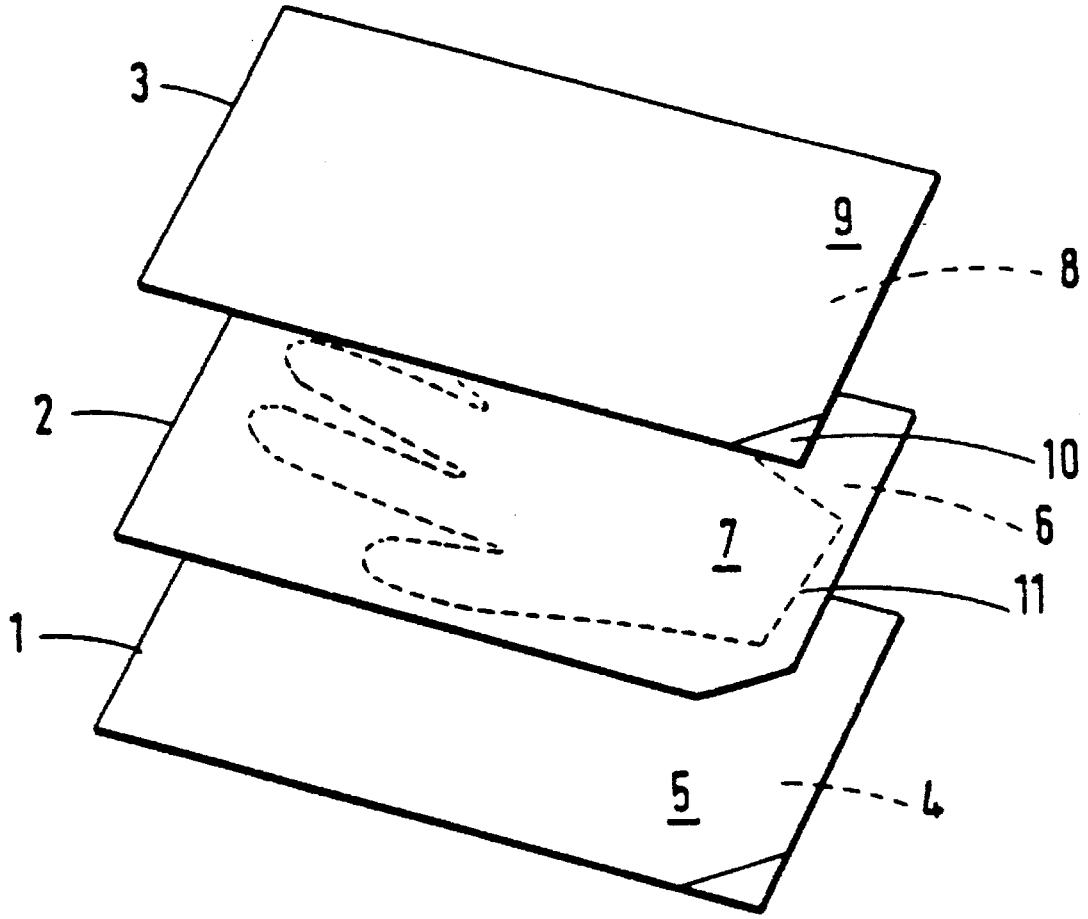
3
9
8
2
10
6
7
11
1
5
4

PROTECTIVE DEVICES

This is a continuation of application Ser. No. 07/825,302, filed on Jan. 24, 1992, now abandoned, which is a continuation of application Ser. No. 07/457,739, filed Jan. 16, 1990, (now abandoned) and International Application PCT/GB88/00562, filed on Jul. 13, 1988, published as WO89/00385, Jan. 26, 1989, and which designated the U.S.

FIELD OF THE INVENTION

This invention relates to protective devices particularly for handling easily contaminated materials.

BACKGROUND TO THE INVENTION

With increasing sensitivity in public health there is a considerable demand for means for handling sensitive materials particularly foodstuffs. However, in general there is also a need for easily disposable items which can be used to protect the hands for a short time. At the present time there are various forms of gloves including disposable gloves. These will encompass the whole hand and, when made of water or dirt resistant materials, tend to be uncomfortable to wear because of the inability to get rid of perspiration easily. Also such protective items as gloves, particularly when made of inexpensive materials which are readily disposable tend to be difficult to put on the hand. A glove made of a thin plastic material may indeed offer resistance to the entry of the hand into the glove. Moreover, such protective items are complex to manufacture usually requiring seams between different places on the glove all of which increases the expense.

SUMMARY OF THE INVENTION

According to the present invention there is provided a protective device for covering part of the hand characterised in a sheet having a shape conforming to the shape of at least part of the hand and having disposed over at least a portion of one surface thereof a heat/pressure-sensitive adhesive to attach the device to a hand.

The device can be in the form of a hand with separated fingers or can have one or more of the portions relevant to the fingers formed into a single shape in the rough outline of a mitt. Usually however there will be at least a portion conforming to the thumb of the hand and therefore with an indentation in the sheet corresponding to the thumb outline.

The size of the device whilst generally shaped to conform to the hand should preferably provide a margin of approximately ¼ inch around the hand size, particularly about each finger and the. A marginal area can allow folding up of the device around the periphery of the hand to protect more than the palm surface but usually the margin will not be so wide as to reach the upper or outer side of the hand.

Such devices can be provided in a "pack form" in which a series of devices and release sheets are interspersed. For example in such a system the top sheet could have an underside which was a release sheet placed on top of the adhesive surface of the device immediately underneath. The device as already mentioned could be held to the sheet below by adhesive placed over all or part of the lower sheet. In turn that lower sheet could be the covering sheet with lower release surface disposed over the next layer which is the device. Each layer which comprises the device could comprise simply the device or a device surrounded by the material from which the device is made and optionally joined thereto by remaining break points. The advantage of such a layer construction is that the closeness of the various sheets in the layers which are held to each other by the nature of the materials from which they are formed so that air and particularly contaminants cannot enter into and reach the protective devices. This provides an essentially hermetic protection until use at which time the device is revealed by stripping the sheet immediately above the protective device.

To assist in separating one layer from another there can be introduced tags or uncoated layers as may be required which enable a grip to be secured on a given layer so facilitating separation from the layer beneath. In those cases where it is desired to have both right and left handed protective devices these could be provided in alternating layers.

The protective devices can be placed in a conventional container depending on the shaping and sizing of the layers. In one embodiment there can be formed in the container a surrounding packaging material for example foamed or foamed-extruded polystyrene which is shaped so as to receive a package of the devices and intervening layers in cut-out form i.e. with finger and thumb elements already shaped. In such case the interaction of the surrounding packaging material and the pack of layers of protective devices and intervening sheets can be such that the packing material assists in resisting moving upwards of the lower sheets as each protective device is removed and can also assist in resisting entry of contaminants in the lower levels of the pack. The package could also be a blister pack structure. The packaging can, at a point adjacent to the pack of devices particularly the "finger" shaped portion, have one or more protrusions for the upper portion or entire depth of package bearing on the pack to increase resistance to upward movement of lower layers and assist in keeping the fingers separate.

In this embodiment of the invention one therefore could have a series of alternating layers of release sheets and protective device material sheets comprising as described above a top most sheet with lower release surface, protective element sheet with upper adhesive surface, a further sheet with upper lightly adhesive surface to retain the protective device on it until pulled away by the hand, said lower sheet having as undersurface a release surface for the next protective device and so on down the pack. These can be assembled in a single mass of sheets and cut into the appropriate hand shape by a single die-cut through the mass of asembled sheets leaving a mass with the appropriate hand shape. This can be placed in a package in which there surrounds the mass of elements a foamed polystyrene pack with an opening in hand shaped form to receive the shaped mass of elements. In the portion of the pack for example that corresponds substantially to the wrist area of the hand there can be left an opening in the pack to allow access to the lower layers of the sheets as these are reached.

In another improvement the adhesive used in the devices can be a heat-sensitive material which increase in adhesiveness on application of the hand. This means that the device adheres more firmly to the hand for that portion of the device in actual contact with the hand but the remainder of the surface is less adhesive so avoiding accidental sticking to objects near the hand while the device is in use.

Also the adhesiveness can be created by use of encapsulated adhesives in which the pressure of the hand ruptures capsules embedded in the adhesive layer to release activating agents for the adhesive material or perhaps other materials such as adhesive modifiers, scents bateriostatic agents and the like. For example a material which over a given time diminishes the adhesiveness could be released so that, for a device to be used only for a short time, the diminishing adhesive could ease removal.

The protective devices according to the present invention for all or part of the hand comprise a sheet conforming to the shape of at least part of the hand and have disposed there over at least a portion therefore a heat pressure-sensitive adhesive. The adhesive causes the device to adhere to the hand during use but is of a nature which allows easy removal of the device. Conveniently, there are various constructions for storing and supplying these devices. These constructions include having release sheets between individual protective devices. The free surface of the devices, that is the surface opposed to that adhered to the hand can be treated in various ways, so as to enhance its release properties.

To simplify the construction of a pack of these devices it is also proposed to have on the adhesive-free surface of the protective device a surface which is capable of release from the surface of the adjacent protective device which surface bears she adhesive. Thus there would be no need in such a construction to nave an intervening release sheet.

The release surface on the protective device could result from the nature of the material selected which could be of such a nature that, although when treated on one side the adhesive will adhere to it, the other surface does not adhere to the adhesive. This might be possible by taking a polymeric film, treating one side in such a manner as to ensure adherence of the adhesive while leaving the other surface either free, if it is of a natural release type surface, or alternatively coated with some form of relase agent or otherwise treated on the surface. Some polymeric materials can be treated for example by electrical or other treatments so as to enhance the release properties.

More usually there will be incorporated into the adhesive free surface some form of release agent either by incorporating in the polymeric material forming the film or by coating onto the surface of the film. Such release agents include high molecular weight hydrocarbons, for example waxes, or silicones or other well recognised release agents.

The agent on such release surface must not be such that it will contaminate the adhesive on the adjacent protective device or otherwise it will detrimentally affect the properties of such adhesive. Thus any release agent applied to the surface of the device must in itself be well bonded to such surface.

The product of the invention can be manufactured from a number of materials which can be used for handling the appropriate products. For example, protective elements for use in handling foodstuffs or other items likely to be contaminated by the hand could be polymeric materials which will be resistant to sweat. Where it is desired that the skin under the protective device should be reasonably free to perspire one can use porous materials. Various material which can be applied safely to the skin and will not contaminate the object being handled are known. Commercial materials which could be used in this invention are plastic films such as CONTACT or TRANSPASEAL. The microporous material MICROPORE manufactured by Minnesota Mining and Manufacturing company is particularly suitable because of its porous qualities. Certain types of material usable in masking tape products would be usable in the invention.

In this specification the expression heat/pressure-sensitive is to be taken to be reference to heat or pressure-sensitive.

Heat/pressure sensitive adhesive can also be one of the well-known materials having these properties. Various heat/pressure-sensitive adhesives are available which are particularly useful for application to the skin. The degree of adhesive will depend on the extent to which it is desired to make the removal of the device easy. An adhesive with a relatively low degree of adhesion could be used for a device which is to be removed very quickly. Slightly greater degrees of adhesion might be appropriate for longer wearing of the device. The choice of a material having the appropriate degree of adhesion would offer no problem to one skilled in the art.

The adhesive may be applied over the whole of the surface of she device which is to be applied to the skin or only over sufficient of the areas of the device so as to ensure containued adhesion to the hand for the period of use.

It will be an advantage if the areas designated to become the protective cover to be hand has drawn on it an outline of the fingers and thumb to provide a guide to the user's placement.

For the purpose of dispensing these devices they can be provided applied to backing materials with release surfaces readily to release the adhesive coated side of the device. For this purpose the device may have an adhesive-free zone which will allow initial removal of the device from the backing paper. When individual devices are employed these can be either right-handed or left-handed and the backing can conform to the exact shape of the device or could be a more general shape. For example, in a device having individual finger shaped portions the backing material could be a single mass. This can be advantageous in avoiding movement of the finger portions towards each other as they are moved from the backing material. The devices can be dispensed in a single sheet, the device being outlined by a breakable portion or tearable portion so that when the hand is applied to the device and adhered by the adhesive, movement of the hand away from the sheet breaks the remaining connection between the device and the sheet from which it was formed. In such a context the devices could be dispensed from a continuous roll. As the roll moves towards a dispensing point the backing sheet which has hitherto protected the adhesive covered surface of the device will be removed and at an appropriate point the exposed sheet with devices still as a part thereof can be so disposed as to allow application of the hand, removal of the hand breaking the remaining connection between the device and the surrounding sheet.

In an alternative method the devices could be placed between two sheets, one sheet applied against the adhesive covered side of the device with a release surface between said sheet and the device and the other sheet having a lightly adhesive surface which will release the other side of the device when the hand is applied to the adhesive coated side.

Clearly other means can readily be visualised for dispensing these devices either as individuals or as readily separable portions of sheets.

As noted above the material of the devices can be chosen to prevent contamination from the hand reaching an object to be handled or alternatively to protect the hand from contaminated or dirty articles.

BRIEF DESCRIPTION OF THE DRAWING

One particular embodiment of the present invention will now be described by way of example with reference to the accompanying drawing which shows a protective device in accordance with the present invention including a release sheet on either side of the device.

DESCRIPTION OF PREFERRED EMBODIMENT

In the accompanying drawing reference numerals 1, 2, 3 refer to complete sheets. Numerals 4, 5 are the reverse and obverse sides respectively of sheet 1. Numerals 6, 7 are the reverse and obverse sides respectively of sheet 2, and numerals 8, 9 are the reverse and obverse sides respectively of sheet 3.

Thus it will be seen that 4, 6, 8 represent the reverse of each sheet, and 5, 7, 9 represent the obverse of each sheet as shown in the drawings.

Sheet 1, side 5, has the release material on it. The reverse side 4, is ordinary paper backing. Sheet 2 has its self-adhesive side on the obverse side 7. Sheet 3 has the release material on side 8 and the standard backing on the obverse side 9. Thus when sheet 3 is placed over sheet 2, the relase material on side 8 is in contact with the self-adhesive material on side 7 and consequently may be easily separated from it. Sheet 2 carries a perforated pre-cut outline of a handshape. All the material on sheet 2 that lies outside the handshape has an adhesive on side 6 which firmly adheres to the adhesive on side 5 of sheet 1, so that each device is essentially a sandwich of three sheets. This sequence may be contained by placing a further handshape (sheet 2) on top of sheet 3 (side 9) in the manner in which sheet 2 is applied to side 5.

In use, a bottom left-hand corner area 10 of sheet 3 (which small area 10 is omitted from sheet 2) is grasped and peeled away from sheet 2 leaving the entire side 7 of sheet 2 totally exposed. Thus when the requisite hand (right or left) is placed over the marked outline, this area will adhere to the hand and on the raising of the hand will tear free from the remainder of the sheet along pre-cut perforations 11 and also due to the remainder of sheet 2 being stuck firmly to side 5 of sheet 1.

Such multi-layer packaging ensures the exclusion of all contaminents.

As already mentioned one can assist release of the materials by a release strip. In particular in manufacture, when the adhesive strip is bonded to the release paper there is introduced a band of paper to prevent the adhesive surface abutting the release. The area would correspond to a centimeter in depth and the width of a wrist of the cut-out hands off shape.

The device shape of the combined adhesive and release layers are then stamped out and assembled one on top of the other, release paper uppermost in say bundels of fifty, or one could assemble the sheets and diestamp the bundle. At selected points around the periphery of the shape, a mild adhesive can be added to 'tack' the bundles together. In use, one hand holds the small masked section at the wrist-end, whilst the other peels back the topmost release paper, the hand then being applied to the exposed handshape, which because of the adhesion to the hand tears free from the bundle.

The entire 'block' of say fifty sheets would then be placed within an exact cut-out shape of expanded polystyrene which would serve the purpose of holding the block of devices within the box. Additionally, it would assist the separation of each device sheet by the slight 'grip' developed around the periphery of the device shape.

One such container comprises a substantially solid rectangular box like construction of polystyrene having a central aperture or well extending downwards from an open top thereof, which is of the same external shape and size as the protective devices which are stacked within the well. The well also extends sidewards to one outside surface of the box to define a vertical slot therein of sufficient width to receive the wrist portion of a device and hence the wrist of a person wishing to use a protective device.

To one side of the slot is provided an inverted L-shaped restraining device which projects into the slot to hold a number of protective devices between the base of the container and an undersurface of that portion of the restraining device projecting into the container. The restraining device is preferably 3 cm wide and extends into the container by some 4 mm to define a 'nip' therebetween. The 'nip' thereby supplied is sufficient to restrain that portion of the stack. The natural flexibility of the pack composition has sufficient 'spring' or resilience to take up the slack caused through the gradual successive reduction in the stack height as the separate layers are removed.

In use, having placed the hand on to the top most exposed layer, a slight creasing of the hand is effective to slide the wrist forward and such movement is sufficient to slide out the edge of that device from the 'nip' of the restraining device. Such action frees those peripheral areas that are restrained either by small protrusions around the edge of the well in which the stack sits, and/or the medium areas where the stack has been 'tacked-together' with a sticking medium.

Since the wrist-band of the protective device has a total width of some 6.5 cm the areas not covered by the restraining or 'nipping' device may be restrained manually, using the fingers of the other hand to hold down all but the top most layer. The wrist band is conveniently free of adhesive to facilitate the movement of the devices from the restraining 'nip'.

Clearly other means can readily be visualised for dispensing these devices either as individuals or as readily separable portions of sheets.

As noted above the material of the devices can be chosen to prevent contamination from the hand reaching an object to be handled or alternatively to protect the hand from contaminated or dirty articles, for example, oily articles. Thus, a dispenser for the devices of the invention could be provided in a petrol service station to allow motorists to handle the pump and associated equipment without contamination. The protection of the hand could also be against heat or cold. The device could be manufactured from an insulating material or material which does not readily transmit heat or cold so allowing the user to handle hot or cold objects more safely. The great advantage of the device of the invention is that, while protecting the palm and fingers, the rest of the hand remains uncovered so avoiding discomfort found in devices of the art.

The device of the invention need not be uniform across the whole area of the hand. For example, in the above-mentioned devices made of insulating materials only parts of the device need be heavily insulated depending on the portion of the hand used to handle hot or cold devices. Similarly the surface of the device used for handling objects can over some or all of the surface be modified so as to provide for greater gripping facility either by modifying a single sheet or by applying layers of modified sheets into a laminate structure. Equally, if it is desired to leave a portion of the hand exposed while protecting the rest of the hand this could readily be done by adjusting the sizing and shaping of the device. For example, a device to be used in assisting finger-printing could protect the whole of the hand except for the actual finger prints so avoiding ink from the finger printing process reaching the reminder of the skin.

In an alternative arrangement two such devices (right-hand and left-hand) are placed 'hand-to-hand', so that the adhesive-free surfaces abut each other and are joined at the periphery thereof with a mild adhesive, except at the wrist, where an adhesive-free tab protrudes. This arrangement of devices can be automatically established during manufacture, when the 'stamping-out' of the devices may cause sufficient 'seal' therebetween around the edges of the devices to 'hold' the devices in their correctly opposing positions. Each pair of 'hand-to-hand' devices are then laid between two sheets, one side of each sheet being of 'release' material.

In use, with a stack of devices, the adhesive-free tab is held in the left-hand and the topmost protective sheet is peeled-off with the right-hand, or vice versa. Having peeled-off the protective layer, the adhesive surface of the right-hand device is exposed. The selected hand, that is, the right-hand is then placed over the guide marks. Thus the action of withdrawing the right-hand automatically causes the left-hand device to follow, due to their being affixed together (as previously explained). By placing the left-hand, palm-to-palm, with the right-hand, the adhesive side of the left-hand device will adhere to the left-hand, permitting the devices on each hand to separate from each other when the hands are pulled apart.

We claim:

1. A protective device, comprising;

covering means for covering only part of a user's hand, the covering means comprising a single sheet of material having:

at least a general shape of a user's hand to conform to the shape of at least part of the user's hand;

adhesive attachment means on a first surface for attaching the sheet of material to the user's hand, the adhesive attachment means consisting only of a pressure-sensitive adhesive on at least a portion of the first surface, whereby placing the user's hand on the adhesive retains the sheet of material on the user's hand with the adhesive; and a second surface opposite the first surface of the sheet of material for contacting an article while the sheet of material is attached to the user's hand.

2. A device according to claim 1, wherein the device is made from a material which resists contamination from the hand.

3. A device according to claim 1, wherein the device is made from a material which resists contamination from any object being handled.

4. A device according to claim 1, wherein the device has portions corresponding to the shape of individual fingers and the thumb of a hand.

5. A device as claimed in claim 1, wherein the sheet of material includes a rupture zone so that when at least a part of a hand is placed on the sheet of material within the rupture zone and is attached thereto by the pressure-sensitive adhesive, movement of the hand away from the sheet material ruptures the rupture zone and the portion shaped to conform to at least part of the band is removed from the sheet of material by adherence to the surface of the hand.

6. A device according to claim 1, wherein the sheet of material has at least a portion thereof which conforms to the shape of the individual fingers and thumb of a hand.

7. A device according to claim 1, wherein the sheet material is a micro-porous material.

8. A protective device, comprising;

covering means for covering only part of a user's hand, the covering means comprising a single sheet of material having:

at least a general shape of a user's hand to conform to the shape of at least part of the user's hand;

adhesive attachment means on a first surface for attaching the sheet of material to the user's hand, the adhesive attachment means consisting only of a heat-sensitive adhesive on at least a portion of the first surface, whereby placing the user's hand on the adhesive retains the sheet of material on the user's hand with the adhesive; and a second surface opposite the first surface of the sheet of material for contacting an article while the sheet of material is attached to the user's hand.

* * * * *